US012084305B2

(12) United States Patent
Sakai

(10) Patent No.: US 12,084,305 B2
(45) Date of Patent: Sep. 10, 2024

(54) MEDIUM CONVEYING APPARATUS TO DETERMINE WHETHER OVERLAP DETECTION IS VALID OR INVALID BASED ON POSITION OF END OF MEDIUM

(71) Applicant: PFU LIMITED, Kahoku (JP)

(72) Inventor: Masaaki Sakai, Kahoku (JP)

(73) Assignee: PFU LIMITED, Kahoku (JP)

( * ) Notice: Subject to any disclaimer, the term of this patent is extended or adjusted under 35 U.S.C. 154(b) by 197 days.

(21) Appl. No.: 17/649,599

(22) Filed: Feb. 1, 2022

(65) Prior Publication Data

US 2022/0274794 A1 Sep. 1, 2022

(30) Foreign Application Priority Data

Feb. 26, 2021 (JP) ..... 2021-030503

(51) Int. Cl.
*B65H 7/12* (2006.01)

(52) U.S. Cl.
CPC ..... *B65H 7/125* (2013.01); *B65H 2511/524* (2013.01); *B65H 2553/30* (2013.01); *B65H 2801/03* (2013.01)

(58) Field of Classification Search
CPC ..... B65H 7/125; B65H 7/12; B65H 2553/30; B65H 2511/524
See application file for complete search history.

(56) References Cited

U.S. PATENT DOCUMENTS

2011/0278791 A1* 11/2011 Fujii ..... B65H 7/125 271/265.04
2020/0204695 A1 6/2020 Sakai
2021/0155430 A1* 5/2021 Furukawa ..... H04N 1/00591
2022/0263962 A1* 8/2022 Murahashi ..... G01V 8/12

FOREIGN PATENT DOCUMENTS

JP 2006248701 A * 9/2006
JP 2010-149982 A 7/2010
JP 2020-100459 A 7/2020
JP 2020-158231 A 10/2020

OTHER PUBLICATIONS

Japanese Office Action dated Jul. 16, 2024 regarding Japanese Patent Application No. 2021-030503 corresponding to U.S. Appl. No. 17/649,599 (3 pages) with English Translation (7 pages).

* cited by examiner

*Primary Examiner* — Luis A Gonzalez
(74) *Attorney, Agent, or Firm* — LEWIS ROCA ROTHGERBER CHRISTIE LLP

(57) ABSTRACT

A medium conveying apparatus includes a conveying roller to convey a medium, an end detection sensor for detecting a position of an end of the medium conveyed by the conveying roller, an overlap detection sensor for detecting an overlap of the medium conveyed by the conveying roller in a detection area, and a processor to determine whether an overlap detection is valid or invalid based on a positional relationship between the position of the end of the medium detected by the end detection sensor and the detection area, and execute an abnormality processing for multi-feed based on a detection result by the overlap detection sensor when it is determined that the overlap detection is valid.

20 Claims, 13 Drawing Sheets

MEDIUM CONVEYING APPARATUS TO DETERMINE WHETHER OVERLAP DETECTION IS VALID OR INVALID BASED ON POSITION OF END OF MEDIUM

CROSS-REFERENCE TO RELATED APPLICATIONS

This application is based upon and claims the benefit of priority of prior Japanese Patent Application No. 2021-030503, filed on Feb. 26, 2021, the entire contents of which are incorporated herein by reference.

TECHNICAL FIELD

Embodiments discussed in the present specification relate to medium conveyance.

BACKGROUND

In general, a medium conveying apparatus such as a scanner has a function of detecting whether or not a multi-feed, that is, a plurality of media being conveyed in an overlapping manner has occurred, and automatically stopping the conveyance of the medium when the multi-feed has occurred.

For example, a multi-feed detection apparatus to determine whether or not the multi-feed of the medium has occurred based on a transmission amount of an ultrasonic wave transmitted through a medium using an ultrasonic sensor, is disclosed (Japanese Unexamined Patent Publication (Kokai) No. 2020-100459). The multi-feed detection apparatus compares a signal value of the ultrasonic wave transmitted through the medium with a determination threshold, to determine whether or not the multi-feed of the medium has occurred.

SUMMARY

According to some embodiments, a medium conveying apparatus includes a conveying roller to convey a medium, an end detection sensor for detecting a position of an end of the medium conveyed by the conveying roller, an overlap detection sensor for detecting an overlap of the medium conveyed by the conveying roller in a detection area, and a processor to determine whether an overlap detection is valid or invalid based on a positional relationship between the position of the end of the medium detected by the end detection sensor and the detection area, and execute an abnormality processing for multi-feed based on a detection result by the overlap detection sensor when it is determined that the overlap detection is valid.

According to some embodiments, a method for executing an abnormality processing, includes, conveying a medium, by a conveying roller, determining whether an overlap detection is valid or invalid based on a positional relationship between a position of a end of the medium detected by an end detection sensor for detecting the position of the end of the medium conveyed by the conveying roller and a detection area in which an overlap detection sensor for detecting an overlap of the medium conveyed by the conveying roller, and executing an abnormality processing for multi-feed based on a detection result by the overlap detection sensor when it is determined that the overlap detection is valid.

According to some embodiments, a computer-readable, non-transitory medium stores a computer program. The computer program causes a medium conveying apparatus including a conveying roller to convey a medium, an end detection sensor for detecting a position of an end of the medium conveyed by the conveying roller, and an overlap detection sensor for detecting an overlap of the medium conveyed by the conveying roller in a detection area, to execute a process including determining whether an overlap detection is valid or invalid based on a positional relationship between the position of the end of the medium detected by the end detection sensor and the detection area, and executing an abnormality processing for multi-feed based on a detection result by the overlap detection sensor when it is determined that the overlap detection is valid.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus, a method for executing an abnormality processing, and a computer-readable, non-transitory medium storing a computer program according to an embodiment, will be described with reference to the drawings. However, it should be noted that the technical scope of the invention is not limited to these embodiments, and extends to the inventions described in the claims and their equivalents.

Figure 1:
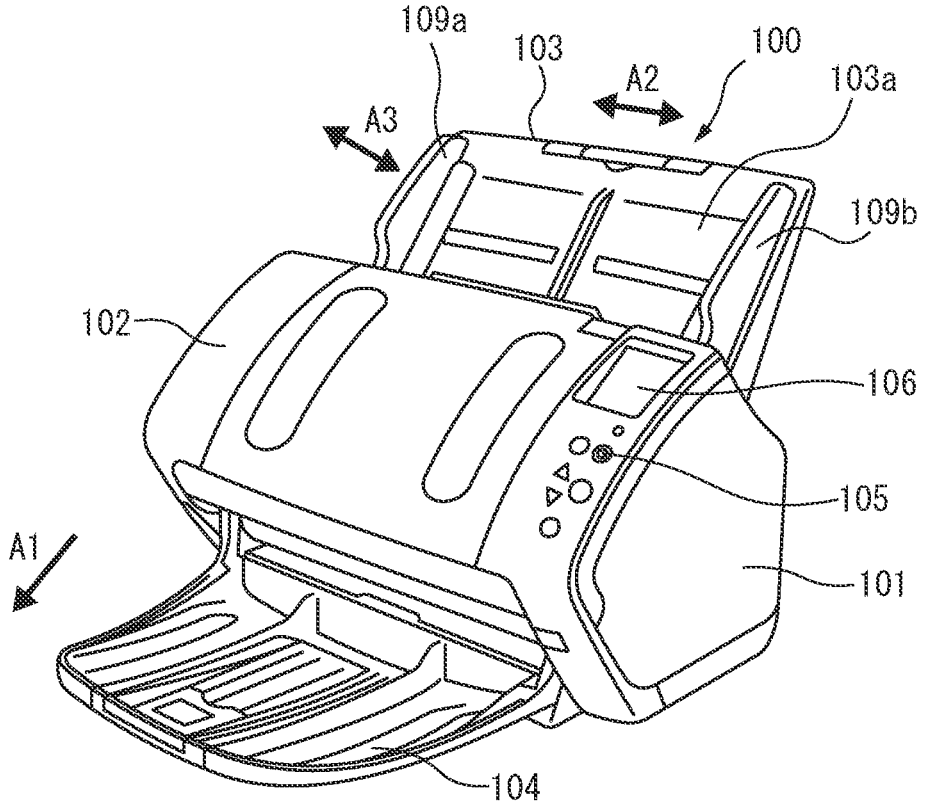
FIG. 1 is a perspective view illustrating a medium conveying apparatus 100 according to the embodiment.

FIG. 1 is a perspective view illustrating a medium conveying apparatus 100 according to an embodiment configured as an image scanner. The medium conveying apparatus 100 conveys and images a medium being a document. The medium is a paper, a card, a booklet, etc. The paper includes thin paper or cardboard, etc. The booklet includes a passport or a passbook, etc. The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

The medium conveying apparatus 100 includes a lower housing 101, an upper housing 102, a medium tray 103, an ejection tray 104, an operation device 105, and a display device 106.

The upper housing 102 is located at a position covering the upper surface of the medium conveying apparatus 100 and is engaged with the lower housing 101 by hinges so as to be opened and closed at a time of medium jam, during cleaning the inside of the medium conveying apparatus 100, etc.

A top surface of the lower housing 101 forms a lower guide 107*a* of a conveyance path of a medium, and a bottom surface of the upper housing 102 forms an upper guide 107*b* of the conveyance path of a medium. An arrow A1 in FIG. 1 indicates a medium conveying direction. Hereinafter, an upstream refers to an upstream in the medium conveying direction A1, and a downstream refers to a downstream in the medium conveying direction A1.

The medium tray 103 is engaged with the lower housing 101 in such a way as to be able to place a conveyed medium. The medium tray 103 has a placing surface 103*a* on which a medium is placed. A first side guide 109*a* and a second side guide 109*b* are provided on the placing surface 103*a*. The first side guide 109*a* and the second side guide 109*b* regulate a position of the medium in the width direction A2. Hereinafter, the first side guide 109*a* and the second side guide 109*b* may be collectively referred to as side guides 109. Each side guide 109*a*, 109*b* is movably provided in the width direction A2 perpendicular to the medium conveying direction on the medium tray 103. Each side guide 109*a*, 109*b* has a predetermined height in the height direction A3, to regulate the width direction of the medium placed on the medium tray 103. Normally, the first side guide 109*a* is located at the leftmost position, and the second side guide 109*b* is moved according to the width of the medium.

The ejection tray 104 is engaged with the lower housing 101 in such a way as to be able to hold an ejected medium.

The operation device 105 includes an input device such as a button, and an interface circuit acquiring a signal from the input device, receives an input operation by a user, and outputs an operation signal based on the input operation by the user. The display device 106 includes a display including a liquid crystal or organic electro-luminescence (EL), and an interface circuit for outputting image data to the display, and displays the image data on the display.

Figure 2:
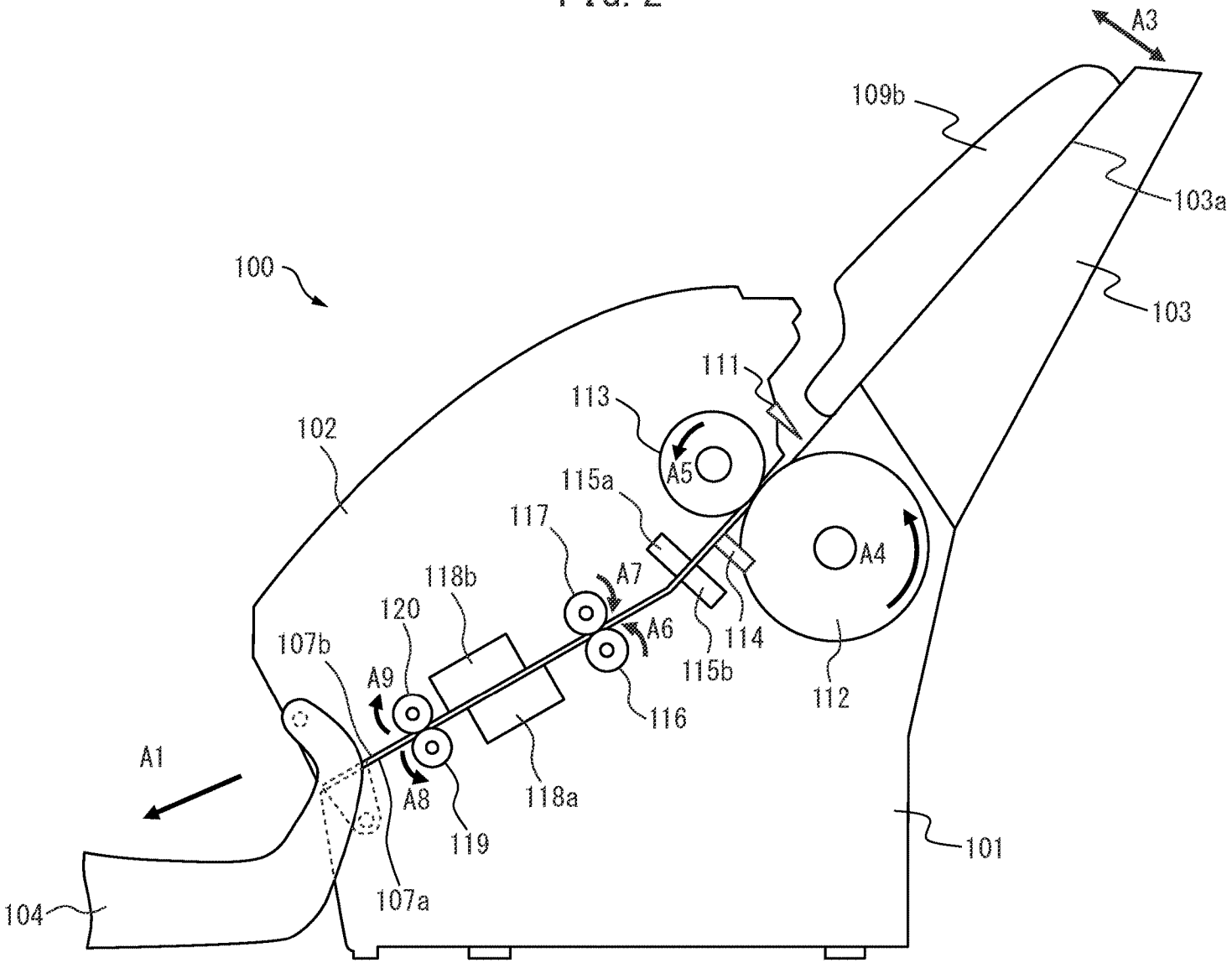
FIG. 2 is a diagram for illustrating a conveyance path inside the medium conveying apparatus 100.

FIG. 2 is a diagram for illustrating a conveyance path inside the medium conveying apparatus 100.

A conveyance path inside the medium conveying apparatus 100, includes a contact sensor 111, a feed roller 112, a brake roller 113, a medium sensor 114, an ultrasonic transmitter 115*a*, an ultrasonic receiver 115*b*, a first conveyance roller 116, a second conveyance roller 117, a first imaging device 118*a*, a second imaging device 118*b*, a third conveyance roller 119 and a fourth conveyance roller 120, etc. The feed roller 112, the brake roller 113, the first conveyance roller 116 and the second conveyance roller 117 are examples of a conveying roller to convey a medium. The numbers of each roller is not limited to one, and may be plural. The first imaging device 118*a* and the second imaging device 118*b* may be collectively referred to as imaging devices 118.

The contact sensor 111 is located on the upstream side of the feed roller 112 and the brake roller 113. The contact sensor 111 detects whether or not the medium is placed on the medium tray 103 by the contact detection of the medium. The contact sensor 111 generates and outputs a first medium signal whose signal value changes in a state where the medium is placed on the medium tray 103 and a state where the medium is not placed.

The feed roller 112 is provided on the lower housing 101, and sequentially feeds media placed on the medium tray 103 from the lower side. The brake roller 113 is provided in the upper housing 102, and is located to face the feed roller 112.

The medium sensor 114 is located on the downstream side of the feed roller 112 and the brake roller 113 and on the upstream side of the first conveyance roller 116 and the second conveyance roller 117. The medium sensor 114 detects whether or not the medium exists at the position. The medium sensor 114 includes a light emitter and a light receiver provided on one side with respect to the conveyance path of the medium, and a reflection member such as a mirror provided at a position facing the light emitter and the light receiver with the conveyance path in between (not shown). The light emitter emits light toward the conveyance path. On the other hand, the light receiver receives light projected by the light emitter and reflected by the reflection member, and generates and outputs a second medium signal being an electric signal based on intensity of the received light. Since the light emitted by the light emitter is shielded by the medium when the medium is present at the position of the medium sensor 114, the signal value of the second medium signal is changed in a state where the medium is present at the position of the medium sensor 114 and a state where the medium is not present. The light emitter and the light receiver may be provided at positions facing one another with the conveyance path in between, and the reflection member may be omitted.

The ultrasonic transmitter 115*a* and the ultrasonic receiver 115*b* are located on the downstream side of the feed roller 112 and the brake roller 113 and on the upstream side of the first conveyance roller 116 and the second conveyance roller 117 in the medium conveying direction A1. The ultrasonic transmitter 115*a* and the ultrasonic receiver 115*b* are located close to the conveyance path of a medium in such a way as to face one another with the conveyance path in between. The ultrasonic transmitter 115*a* is capable of outputting an ultrasonic wave. On the other hand, the ultrasonic receiver 115*b* receives an ultrasonic wave being transmitted by the ultrasonic transmitter 115*a* and passing through a medium, and generates and outputs an ultrasonic signal being an electric signal corresponding to the received ultrasonic wave. The ultrasonic transmitter 115*a* and the ultrasonic receiver 115*b* may be hereinafter collectively referred to as an ultrasonic sensor 115. The ultrasonic receiver 115*b* detects the transmission intensity of the ultrasonic wave transmitted through the medium. The ultrasonic sensor 115 is an example of an overlap detection sensor for detecting an overlap of the medium conveyed by the conveying roller in a detection area.

The first conveyance roller 116 and the second conveyance roller 117 are located on the downstream side of the feeding roller 112 and the brake roller 113 and on the upstream side of the imaging device 118 in the medium conveying direction A1.

The first imaging device 118*a* is located on the downstream side of the first conveyance roller 116 and the second conveyance roller 117 in the medium conveying direction A1. The first imaging device 118*a* includes a line sensor based on a unity-magnification optical system type contact image sensor (CIS) including an imaging element based on a complementary metal oxide semiconductor (CMOS) linearly located in a main scanning direction. The main scanning direction is a direction perpendicular to the medium conveying direction. The line sensor is an example of an imaging sensor to image a medium. The first image pickup device 118*a* includes a light source to irradiate light toward the conveyed medium, a lens for forming an image on the imaging element, and an A/D converter for amplifying and analog-digital (A/D) converting an electric signal output from the imaging element. The first imaging device 118*a* sequentially generates and outputs line images acquired by imaging an area of a front surface of the conveyed medium facing the line sensor at certain intervals. Specifically, a pixel count of a line image in a vertical direction (sub-scanning direction) is 1, and a pixel count in a horizontal direction (main scanning direction) is larger than 1. The first imaging device 118*a* is an example of an end detection sensor for detecting a position of an end of the medium conveyed by the conveying roller. The line image is an example of an input image acquired by imaging the medium.

Similarly, the second imaging device 118*b* is located on the downstream side of the first conveyance roller 116 and the second conveyance roller 117 in the medium conveying direction A1. The second imaging device 118*b* includes a line sensor based on a unity-magnification optical system type CIS including an imaging element based on a CMOS linearly located in a main scanning direction. The line sensor is an example of an imaging sensor to image a medium. Further, the second imaging device 118*b* includes a light source to irradiate light toward the conveyed medium, a lens for forming an image on the imaging element, and an A/D converter for amplifying and analog-digital (A/D) converting an electric signal output from the imaging element. The second imaging device 118*b* sequentially generates and outputs line images acquired by imaging an area of a back surface of the conveyed medium facing the line sensor at certain intervals. The second imaging device 118*b* is an example of the end detection sensor for detecting the position of the end of the medium conveyed by the conveying roller.

Only either of the first imaging device 118*a* and the second imaging device 118*b* may be located in the medium conveying apparatus 100 and only one surface of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs.

A medium placed on the medium tray 103 is conveyed between the lower guide 107*a* and the upper guide 107*b* in the medium conveying direction A1 by the feed roller 112 rotating in a direction of an arrow A4 in FIG. 2. When a medium is conveyed, the brake roller 113 rotates in a direction of an arrow A3. By the workings of the feed rollers 112 and the brake rollers 113, when a plurality of media are placed on the medium tray 103, only a medium in contact with the feed rollers 112, out of the media placed on the medium tray 103, is separated. Consequently, the medium conveying apparatus 100 operates in such a way that conveyance of a medium other than the separated medium is restricted (prevention of multi-feed). The feed roller 112 and the brake roller 113 are an example of a feeding roller to feed by separating the medium placed on the medium tray 103.

The medium is fed between the first conveyance roller 116 and the second conveyance roller 117 while being guided by the lower guide 107*a* and the upper guide 107*b*. The medium is fed between the first imaging device 118*a* and the second imaging device 118*b* by the first conveyance roller 116 and the second conveyance roller 117 rotating in directions of an arrow A6 and an arrow A7, respectively. The medium read by the imaging devices 118 is ejected on the ejection tray 104 by the third conveyance roller 119 and the fourth conveyance roller 120 rotating in directions of an arrow A8 and an arrow A9, respectively.

Figure 3:
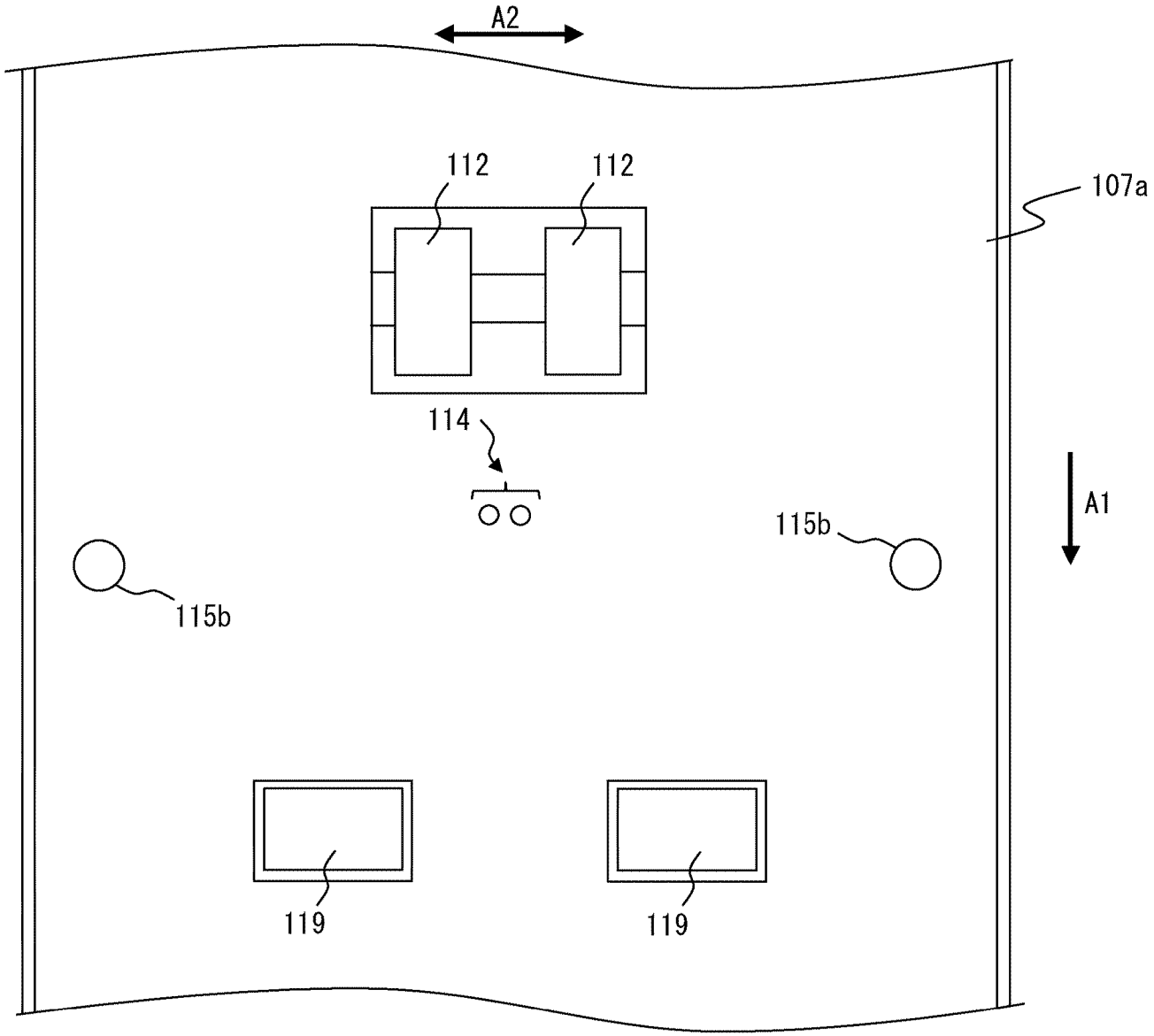
FIG. 3 is a schematic diagram for illustrating an arrangement of an ultrasonic sensor 115, etc.

FIG. 3 is a schematic diagram for illustrating an arrangement of the ultrasonic transmitter 115*a*, etc. FIG. 3 is a schematic view of the lower guide 107*a* of the medium conveying apparatus 100 as viewed from above.

As shown in FIG. 3, two ultrasonic receivers 115*b* are located between the feeding roller 112 and the third conveying roller 119 in the medium conveying direction A1. Further, the two ultrasonic receivers 115*b* are located apart from each other along in the width direction A2. In the example shown in FIG. 3, the ultrasonic receivers 115*b* are located at both ends of the lower guide 107*a* in the width direction A2. Two ultrasonic transmitters 115*a* are located at the position facing the ultrasonic receiver 115*b* in the upper guide 107*b*. Since the two ultrasonic transmitters 115*a* (ultrasonic sensors 115) are located apart from each other in the width direction A2 of the lower guide 107*a*, the medium conveying apparatus 100 can detect both ends in the width direction of the medium. The number of ultrasonic sensors 115 is not limited to two, and may be one, or three or more.

The medium sensor 114 is located between the ultrasonic transmitter 115*a* and the feed roller 112 in the medium conveying direction A1.

Figure 4:
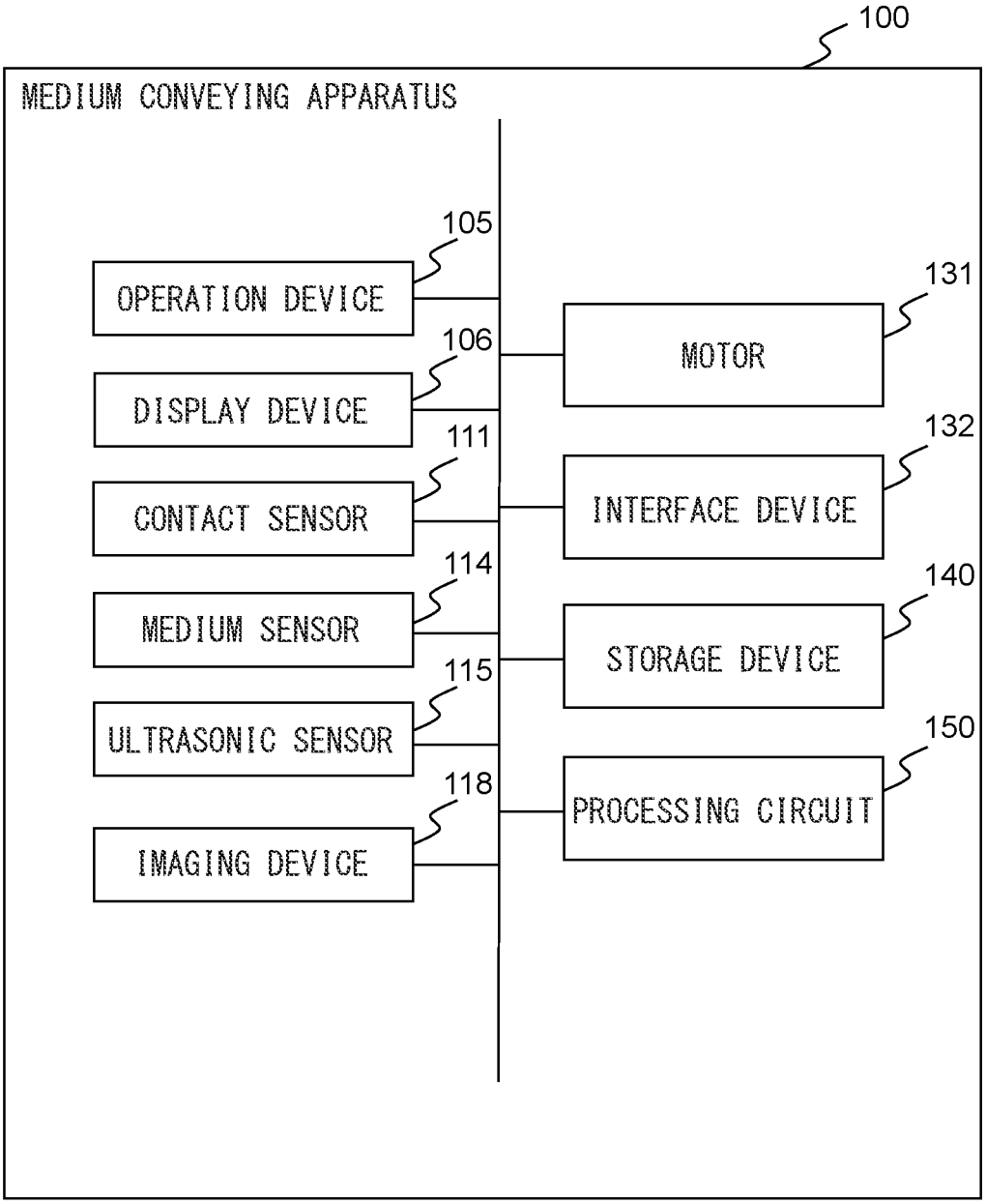
FIG. 4 is a block diagram illustrating a schematic configuration of the medium conveying apparatus 100.

FIG. 4 is a block diagram illustrating a schematic configuration of the medium conveying apparatus 100.

The medium conveying apparatus 100 further includes a motor 131, an interface device 132, a storage device 140, and a processing circuit 150, etc., in addition to the configuration described above.

The motor 131 includes one or more motors to rotate the feed roller 112, the brake roller 113, and the first to fourth conveyance rollers 116, 117, 119 and 120 to convey the medium by a control signal from the processing circuit 150.

For example, the interface device 132 includes an interface circuit conforming to a serial bus such as universal serial bus (USB), is electrically connected to an unillustrated information processing device, and transmits and receives the medium image and various types of information. Further, a communication device including an antenna transmitting and receiving wireless signals, and a wireless communication interface device for transmitting and receiving signals through a wireless communication line in conformance with a predetermined communication protocol may be used in place of the interface device 132. For example, the predetermined communication protocol is a wireless local area network (LAN).

The storage device 140 includes a memory device such as a random access memory (RAM) or a read only memory (ROM), a fixed disk device such as a hard disk, or a portable storage device such as a flexible disk or an optical disk. Further, the storage device 140 stores a computer program, a database, a table, etc., used for various types of processing in the medium conveying apparatus 100. The computer program may be installed on the storage device 140 from a computer-readable, non-transitory medium such as a compact disc read only memory (CD-ROM), a digital versatile disc read only memory (DVD-ROM), etc., by using a well-known setup program, etc.

The storage device 140 stores an arrangement position of the ultrasonic sensor 115 and an arrangement position of the imaging device 118 in the medium conveyance path, as data.

The processing circuit 150 operates in accordance with a program previously stored in the storage device 140. The processing circuit 150 is, for example, a CPU (Central Processing Unit). The processing circuit 150 may be a digital signal processor (DSP), a large scale integration (LSI), an application specific integrated circuit (ASIC), a field-programmable gate array (FPGA), etc.

The processing circuit 150 is connected to the operating device 105, the display device 106, the contact sensor 111, the medium sensor 114, the ultrasonic sensor 115, the imaging device 118, the motor 131, the interface device 132 and the storage device 140, etc., and controls each of these units. The processing circuit 150 performs drive control of the motor 131, imaging control of the imaging device 118, etc., generates the medium image, and transmits the medium image to the information processing apparatus via the interface device 132. Further, the processing circuit 150 determines whether an overlap detection is valid or invalid, based on the line image, etc., from the imaging device 118. When it is determined that the overlap detection is valid, the processing circuit 150 determines whether or not the multi-feed of the medium has occurred based on the ultrasonic signal, etc., from the ultrasonic sensor 115.

Figure 5:
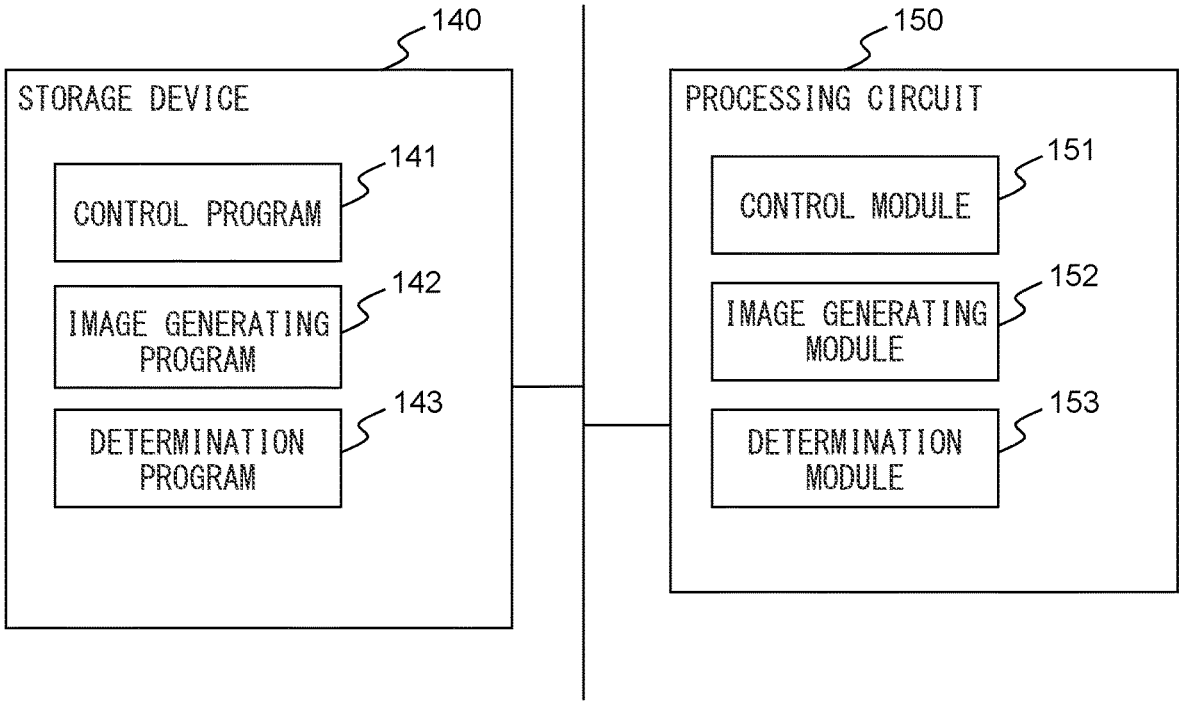
FIG. 5 is a diagram illustrating schematic configurations of the storage device 140 and the processing circuit 150.

FIG. 5 is a diagram illustrating schematic configurations of the storage device 140 and the processing circuit 150.

As shown in FIG. 5, the storage device 140 stores a control program 141, an image generation program 142, and a determination program 143, etc. Each of these programs is a functional module implemented by software operating on a processor. The processing circuit 150 reads each program stored in the storage device 140 and operates in accordance with each read program. Thus, the processing circuit 150 functions as a control module 151, an image generating module 152 and a determination module 153.

Figure 6:
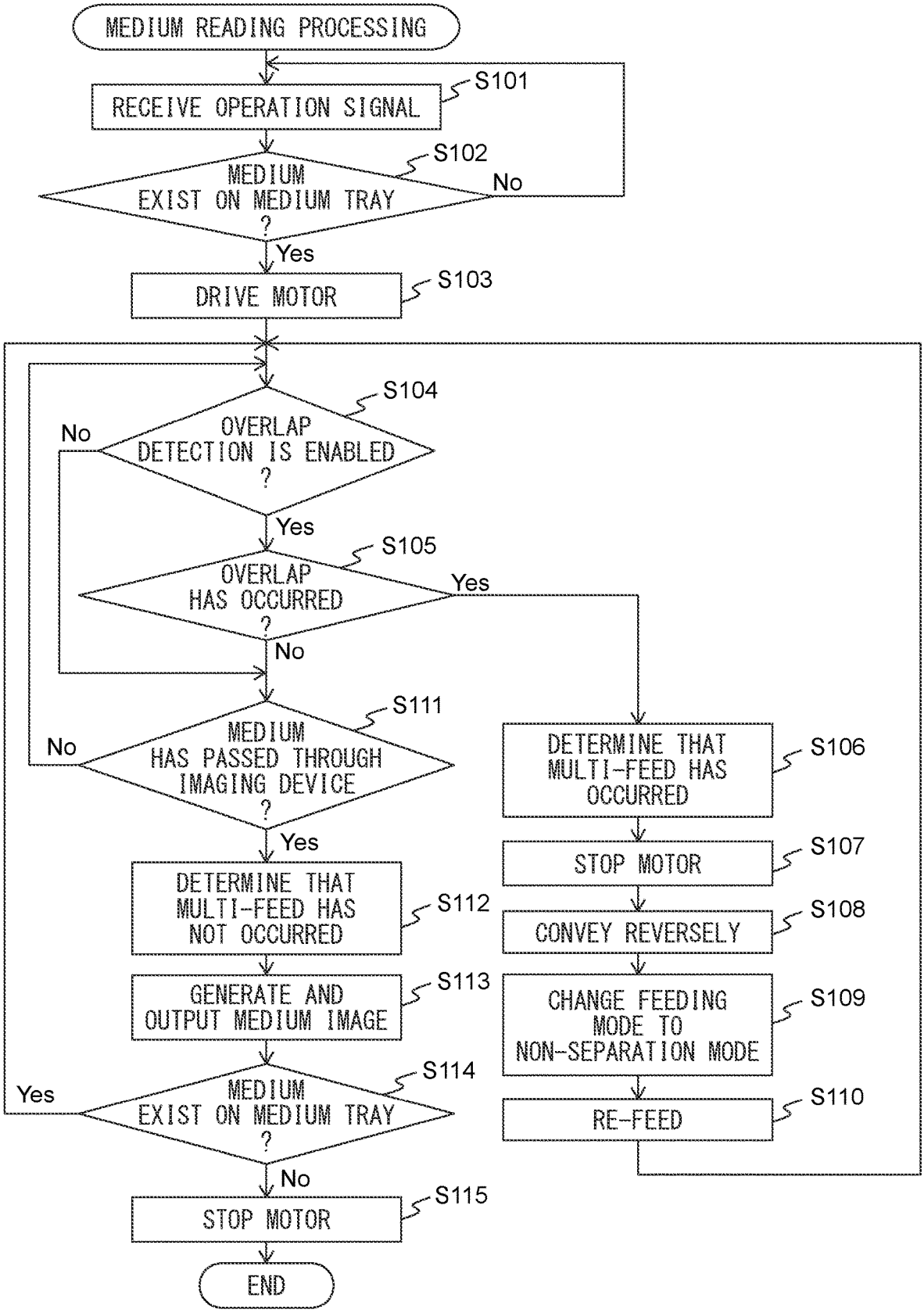
FIG. 6 is a flowchart illustrating an operation example of a medium reading processing.

FIG. 6 is a flowchart illustrating an operation example of medium reading processing in the medium conveying apparatus 100.

Referring to the flowchart illustrated in FIG. 6, an operation example of the medium reading processing in the medium conveying apparatus 100 will be described below. The operation flow described below is executed mainly by the processing circuit 150 in cooperation with each element in the medium conveying apparatus 100, in accordance with a program previously stored in the storage device 140. The operation flow illustrated in FIG. 6 is periodically executed. The medium conveying apparatus 100 has a separation mode for feeding by separating a plurality of media, and a non-separation mode for feeding without separating the medium, as a feeding mode for feeding the medium. The flow of operation shown in FIG. 6 is performed when the feeding mode is set to the separation mode.

First, the control module 151 stands by until an instruction to read a medium is input by a user by use of the operation device 105, and an operation signal instructing to read the medium is received from the operation device 105 (step S101).

Next, the control module 151 acquires the first medium signal from the contact sensor 111, and determines whether or not a medium is placed on the medium tray 103 based on the acquired first medium signal (step S102).

When a medium is not placed on the medium tray 103, the control module 151 returns the processing to step S101 and stands by until newly receiving an operation signal from the operation device 105.

On the other hand, when the medium is placed on the medium tray 103, the control module 151 drives the motor 131 and rotates the feeding roller 112, the brake roller 113, and the first to fourth conveyance rollers 116, 117, 119, and 120 to convey the medium (step S103). In the separation mode, the control module 151 drives the motor 131 to rotate the feed roller 112 and the first to fourth conveyance rollers 116, 117, 119 and 120 in the directions (the medium feeding direction or the medium conveying direction) of the arrows A4, A6, A7, A8 and A9, respectively. Further, the control module 151 drives the motor 131 to rotate the brake roller 113 in the direction of the arrow A5 (the direction opposite to the medium feeding direction).

Next, the determination module 153 determines whether it is determined the overlap detection is valid or it is determined the overlap detection is invalid in a validity determination processing (step S104). The determination module 153 determines whether an overlap detection is valid or invalid based on a positional relationship between a position of an end of the medium detected by the imaging device 118 and a detection area of the medium in which the ultrasonic wave is transmitted, in the validity determination processing. Details of the validity determination processing will be described later.

When it is determined that the overlap detection is valid (step S104—Yes), the determination module 153 determines whether or not it is determined that the multi-feed of the medium has occurred in the multi-feed determination process (step S105). Details of the multi-feed determination processing will be described later.

When it is determined that the multi-feed of the medium has occurred by the determination module 153, the control module 151 determines that the multi-feed of the medium has occurred (S106 of steps).

Next, when it is determined that a conveyance abnormality of the medium has occurred, the control module 151 stops the motor 131 and stops feeding and conveying the medium, as an abnormality processing for the multi-feed (step S107). The control module 151 can suppress damage to the medium, by stopping the feeding and the conveying of the medium when the multi-feed of the medium has occurred. Further, the control module 151 notifies the user of a warning by displaying information indicating that the multi-feed has occurred on the display device 106 or transmitting the information to the information processing device via the interface device 132, as an abnormality processing for the multi-feed, as the abnormality processing for the multi-feed.

Next, the control module 151 drives the motor 131 to rotate the feed roller 112 and the first to fourth conveyance rollers 116, 117, 119 and 120 in the directions opposite to the arrows A4, A6, A7, A8 and A9 (the medium feeding direction or the medium conveying direction), respectively. Further, the control module 151 drives the motor 131 to rotate the brake roller 113 in the direction of the arrow A5 (the direction opposite to the medium feeding direction). Thus, the control module 151 conveys reversely the medium, and once returns the medium to the medium tray 103, as the abnormality processing for the multi-feed (step S108).

Next, the control module 151 changes the feeding mode from the separation mode to the non-separation mode (step S109). In the non-separation mode, the control module 151 rotates the feed roller 112 and the first to fourth conveyance rollers 116, 117, 119 and 120 in the directions (the medium feeding direction or the medium conveying direction) of the arrows A4, A6, A7, A8 and A9, respectively. Further, in the non-separation mode, the control module 151 shuts off the driving force from the motor 131 to the brake roller 113 to turn off the separation function of the medium to be fed. The control module 151 may turn off the separation function of the medium to be fed by rotating the brake roller 113 in the medium feeding direction (the direction opposite to the arrow A5) or by reducing the separation force by the brake roller 113. In step S109, the control module 151 may control the driving force to the brake roller 113 to reduce the separation force or increase the separation force, instead of turning off the separation function.

Next, the control module 151 re-drives the motor 131 and re-rotates the feeding roller 112 and the first to fourth conveyance rollers 116, 117, 119 and 120 in the medium feeding direction or the medium conveying direction to re-feed and re-convey the medium, as the abnormality processing for the multi-feed (step S110). Next, the control module 151 proceeds the process to step S104. At this time, the brake roller 113 is driven by the feed roller 112 or rotates in the medium feeding direction by the motor 131 so as not to separate the medium.

In this way, the control module 151 once returns the medium to the medium tray 103, and controls the feed roller 112 and the brake roller 113 to re-feed without separating when the control module 151 stops feeding the medium. Consequently, a user does not need to re-feed the media by turning off the separation function of the medium, and the control module 151 can improve the convenience of the user. Incidentally, the processes of steps S108 and S110 may be omitted, and the control module 151 may only execute changing the feed mode while stopping feeding and conveying the medium. In that case, since the user does not need to change the feeding mode, the control module 151 can improve the convenience of the user. In this way, the control module 151 executes the abnormality processing for the multi-feed based on the detection result by the supersonic sensor 115 when it is determined that the overlap detection is valid. Further, the control module 151 executes the abnormality processing after detecting the position of the end of the medium. Further, the control module 151 executes the abnormality processing while the medium is conveyed by the conveying roller.

On the other hand, when it is determined that the overlap detection is invalid by the determination module 153 (step S104—No) or when it is determined that the overlap has not occurred by the determination module 153 (step S105—No), the control module 151 determines whether or not the entire medium has passed through an imaging position of the imaging device 118 (step S111). The control module 151, for example, determines whether or not the rear end of the medium has passed through the position of the medium sensor 114 based on the second medium signal received from the medium sensor 114. The control module 151 periodically acquires the second medium signal from the medium sensor 114, and determines that the rear end of the medium has passed through the position of the medium sensor 114 when the signal value of the second medium signal changes from a value indicating that the medium is present to a value indicating that there is no medium. The control module 151 determines that the rear end of the medium has passed through the imaging position of the imaging device 118 and the entire medium has been imaged when a predetermined time has elapsed since the rear end of the medium passes through the position of the medium sensor 114. The control module 151 may determine the entire conveyed medium has been imaged when a predetermined time has elapsed since the start of feeding of the medium. When the entire medium has not yet passed through the imaging position, the control module 151 returns the process to step S104.

On the other hand, when the entire medium has passed through the imaging position, the control module 151 determines that the multi-feed of the medium has not occurred (step S112).

Next, the image generating module 152 acquires each line image generated during conveying the medium from the imaging device 118, synthesizes all the acquired line images to generate the medium image, and transmits it to the information processing apparatus via the interface device 132 (step S113).

Next, the control module 151 determines whether or not the medium remains on the medium tray 103 based on the first medium signal acquired from the contact sensor 111 (step S114). When a medium remains on the medium tray 103, the control module 151 returns the process to step S104 and repeats the processes in steps S104 to S114.

On the other hand, when a medium does not remain on the medium tray 103, the control module 151 stops the motor 131 to stop conveying the medium (step S115), and ends the series of steps.

The processes in step S108 to S110 may be omitted, and the control module 151 may end the series of steps without executing the re-feeding of the medium when the control module 151 stops the feeding and the conveying of the medium.

Figure 7:
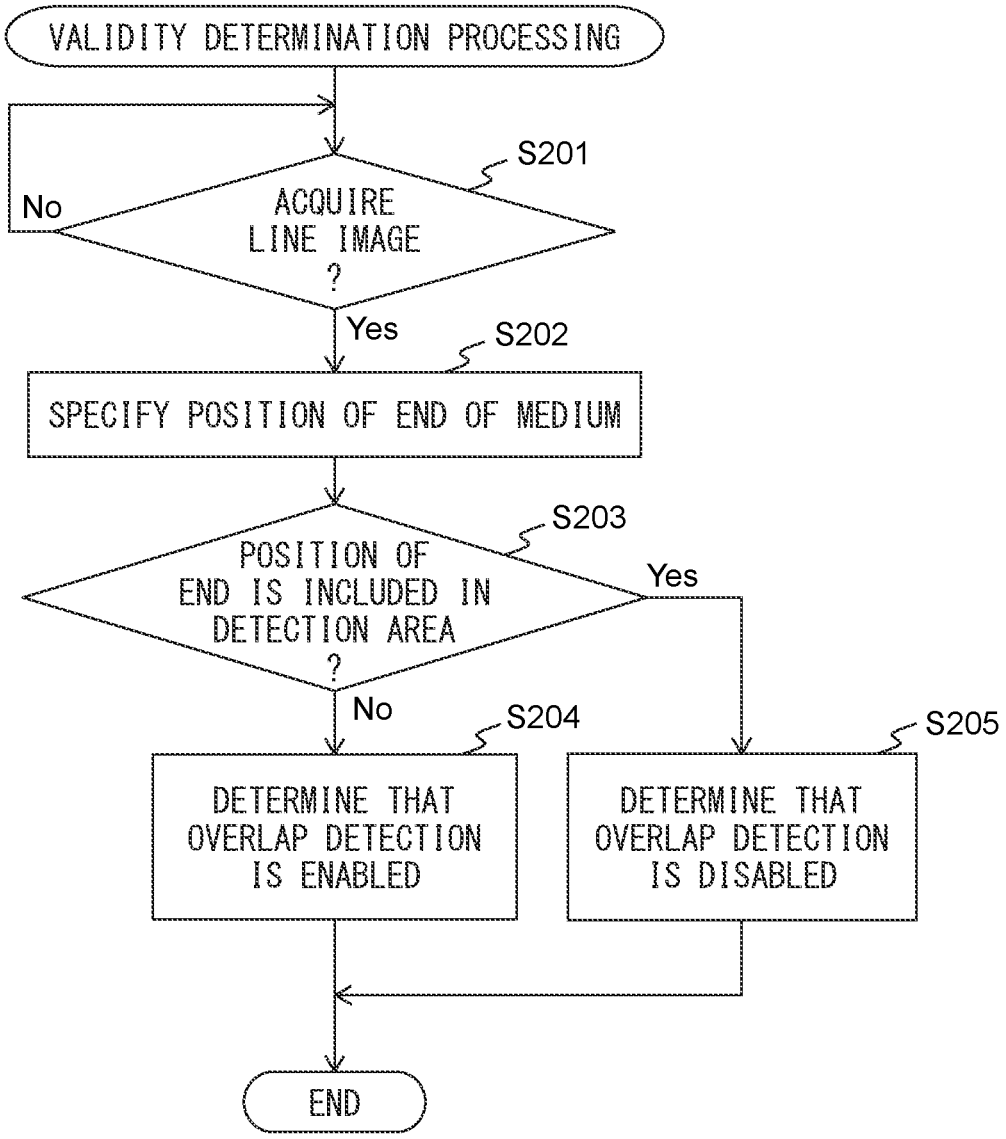
FIG. 7 is a flowchart illustrating an operation example of a validity determination processing.

FIG. 7 is a flowchart illustrating an operation example of the validity determination processing.

Referring to the flowchart illustrated in FIG. 6, an operation example of the validity determination processing in the medium conveying apparatus 100 will be described below. The operation flow described below is executed mainly by the processing circuit 150 in cooperation with each element in the medium conveying apparatus 100, in accordance with a program previously stored in the storage device 140. The flow of the operation illustrated in FIG. 7 is periodically executed during medium conveyance.

First, the determination module 153 determines whether or not the determination module 153 has acquired a new line image from the imaging device 118 (step S201). When the determination module 153 has not acquired a new line image, the determination module 153 returns the process to step S201 (step S201—No).

When the determination module 153 has acquired a new line image from the imaging device 118 (step S201—Yes), the control module 151 identifies the position of the end of the medium based on the line image (step S202).

The control module 151 extracts edge pixels from the line image newly acquired from the imaging device 118. The control module 151 calculates an absolute value of the difference between luminance values of both of pixels adjacent to each pixel in a line image in a horizontal direction (hereinafter referred to as an adjacent difference value) and when the adjacent difference value exceeds a threshold value Th1, extracts the pixel as an edge pixel. For example, the threshold Th1 may be set to a difference in brightness value (for example, 20) according to which a person may determine a difference in brightness on an image by visual observation. The control module 151 detects the edge pixel located on the leftmost side as a left end edge pixel, and detects the edge pixel located on the rightmost side as a right end edge pixel, in the line image.

The control module 151 may calculate, for two adjacent pixels in the line image, average values of the luminance values of a plurality of pixels including each one pixel of the two adjacent pixels and adjacent to a side where the one pixel is located, and extract the edge pixel, based on an absolute value of a difference between the two average values of the luminance values. The control module 151 may calculate an absolute value of a difference between gradation values of two pixels apart from each pixel in a line image by a predetermined distance as the adjacent difference value. Further, the edge pixel detection module 151 may detect the edge pixel by comparing the gradation value of each pixel in the input image with the threshold value. For example, when the gradation value of a specific pixel is less than the threshold and the gradation value of a pixel adjacent to the specific pixel or a pixel separated by a predetermined distance is equal to or larger than the threshold, the control module 151 may detect the specific pixel as an edge pixel.

The control module 151 refers to the arrangement position of the imaging device 118 stored in the storage device 140, to specify positions on the medium conveyance path corresponding to the positions of the left edge pixel and the right edge pixel extracted in the line image, as the positions of the ends of the conveyed medium.

Figure 8A:
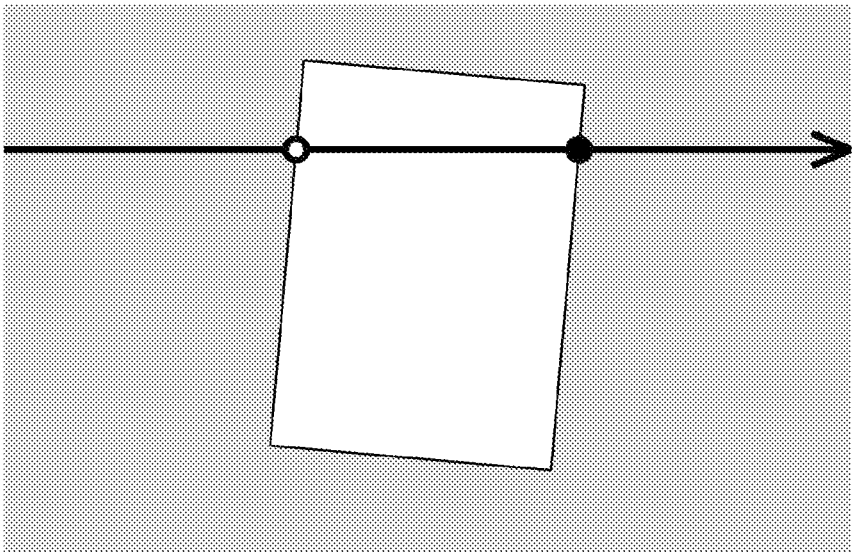
FIG. 8A illustrates an example of a medium image.
Figure 8B:
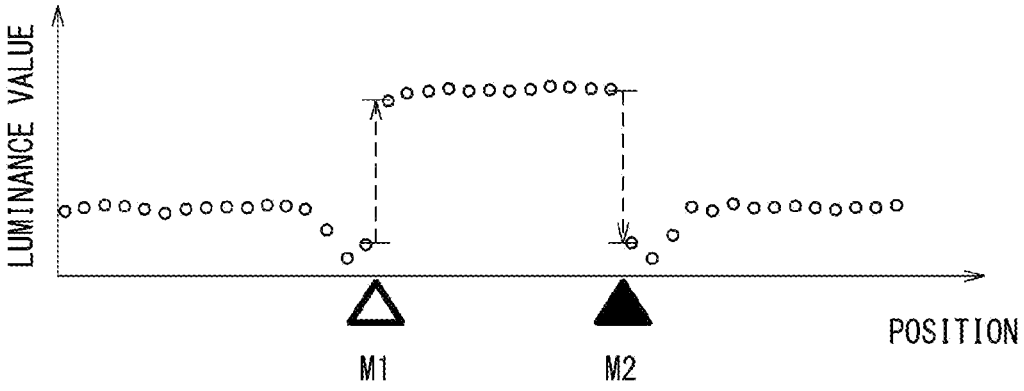
FIG. 8B is an example of a graph showing a luminance value of each pixel in a specific line image in the medium image.

FIG. 8A illustrates an example of the medium image. FIG. 8B is an example of a graph showing the luminance value of each pixel in a specific line image in the medium image.

The horizontal axis indicates positions of pixels in the line image, and the vertical axis indicates the luminance value of each pixel, in FIG. 8B. As shown in FIG. 8A and FIG. 8B, the luminance value changes at a boundary between a medium and a background in the line image. In the example shown in FIG. 8A and FIG. 8B, pixels corresponding to the left end position M1 and the right end position M2 of the medium are extracted as the left end edge pixel and the right end edge pixel.

Next, the determination module 153 determines whether or not the position of the end of the conveyed medium is included in the detection area of the ultrasonic sensor 115 (step S203). The detection area is an area on the medium passing over the ultrasonic receiver 115*b* or the ultrasonic receiver 115*b* and the periphery thereof. The periphery of the ultrasonic receiver 115*b* is an area where variations in the signal value of the ultrasonic signal can occur due to a quenching phenomenon to be described later. The determination module 153 refers to the arrangement position of the ultrasonic sensor 115 stored in the storage device 140, and determines whether or not the position of the end of the medium is included in one of the two detection areas, for each of the two ultrasonic sensors 115.

When the position of the end of the conveyed medium is included in the detection area of the ultrasonic sensor 115 (step S203—Yes), the determination module 153 determines that the overlap detection of the medium is invalid (step S205). On the other hand, when the position of the end of the conveyed medium is not included in the detection area of the ultrasonic sensor 115 (step S203—No), the determination module 153 determines that the overlap detection of the medium is valid (step S204).

Figure 9A:
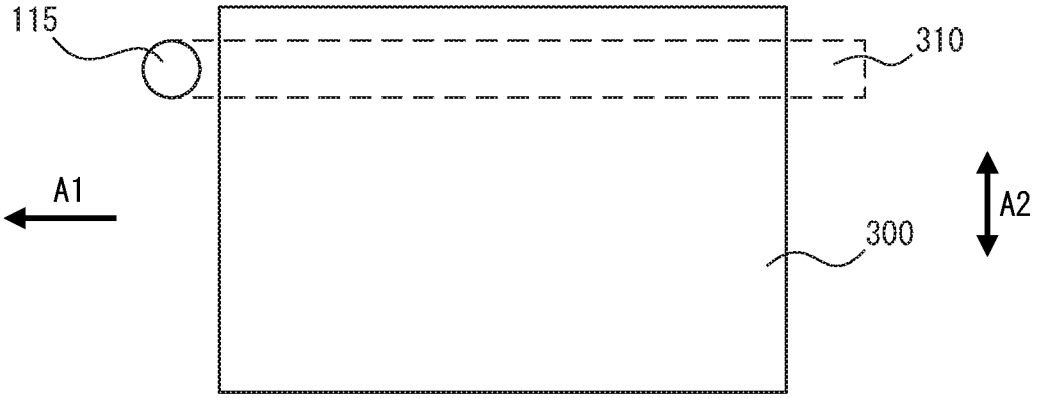
FIG. 9A is a diagram illustrating an example of a positional relationship between a position of an end of a medium and an inspection area.
Figure 9B:
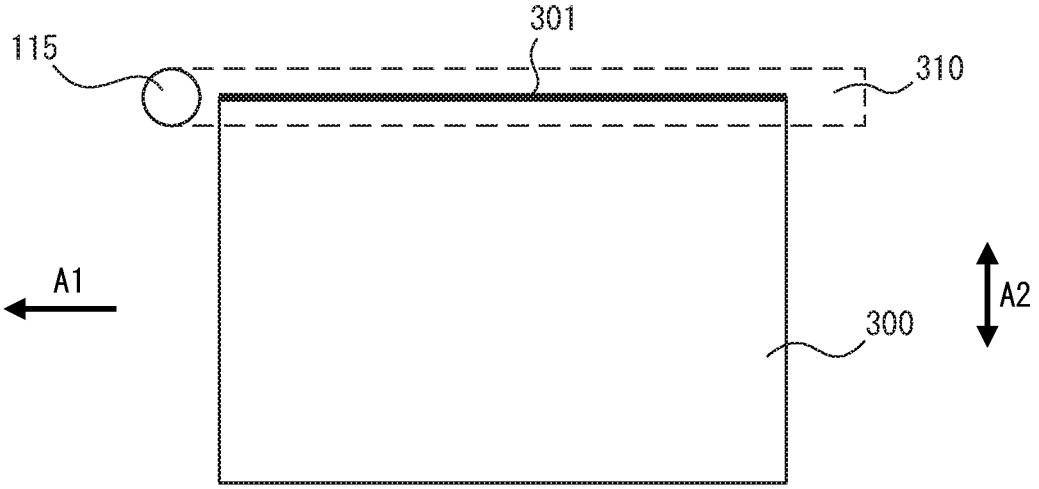
FIG. 9B is a diagram illustrating another example of the positional relationship between the position of the end of the medium and the inspection area.
Figure 9C:
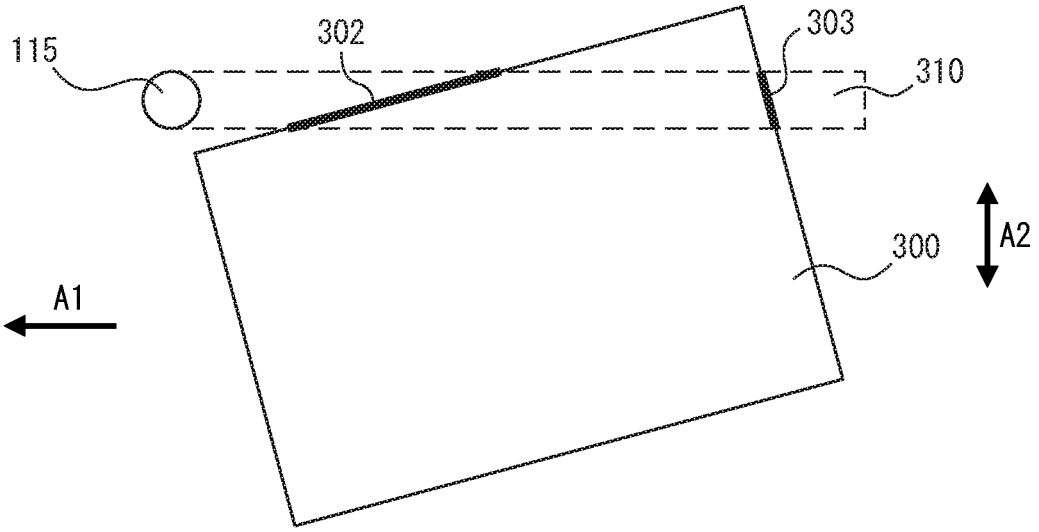
FIG. 9C is a diagram illustrating still another example of the positional relationship between the position of the end of the medium and the inspection area.

FIG. 9A is a diagram illustrating an example of the positional relationship between the position of the end of the medium and the detection area. FIG. 9B is a diagram illustrating another example of the positional relationship between the position of the end of the medium and the detection area. FIG. 9C is a diagram illustrating still another example of the positional relationship between the position of the end of the medium and the detection area. FIG. 9A, FIG. 9B and FIG. 9C show the detection areas 310 on the medium passing over one of the two ultrasonic receivers 115*b* while the medium 300 is conveyed.

In an example shown in FIG. 9A, the position of the end of the width direction A2 perpendicular to the medium conveying direction in the medium 300 is not included in the detection area 310. In this case, the determination module 153 determines that the position of the end of the conveyed medium is not included in the detection area.

In an example shown in FIG. 9B, the medium 300 is conveyed without being inclined, the end 301 of the width direction A2 perpendicular to the medium conveying direction in the medium 300 is included in the detection area 310. In this case, the determination module 153 determines that the position of the end of the medium is included in the detection area at all positions in the conveyed medium in the medium conveying direction A1, and does not determine whether or not the multi-feed of the medium has occurred in the entire area of the medium.

In an example shown in FIG. 9C, the medium 300 is conveyed in an inclined manner, a part 302 of the end of the width direction A2 perpendicular to the medium conveying direction in the medium 300 and a part 303 of the end of the medium conveying direction A1 in the medium 300 are included in the detection area 310. In this case, the determination module 153 determines that the position of the end of the medium is included in the detection area at a part of a position in the conveyed medium in the medium conveying direction A1, and does not determine whether or not the multi-feed of the medium has occurred at the part of the position.

The technical significance of invalidating the multi-feed determination of the medium when the position of the end of the conveyed medium is included in the detection area will be described below.

Figure 10:
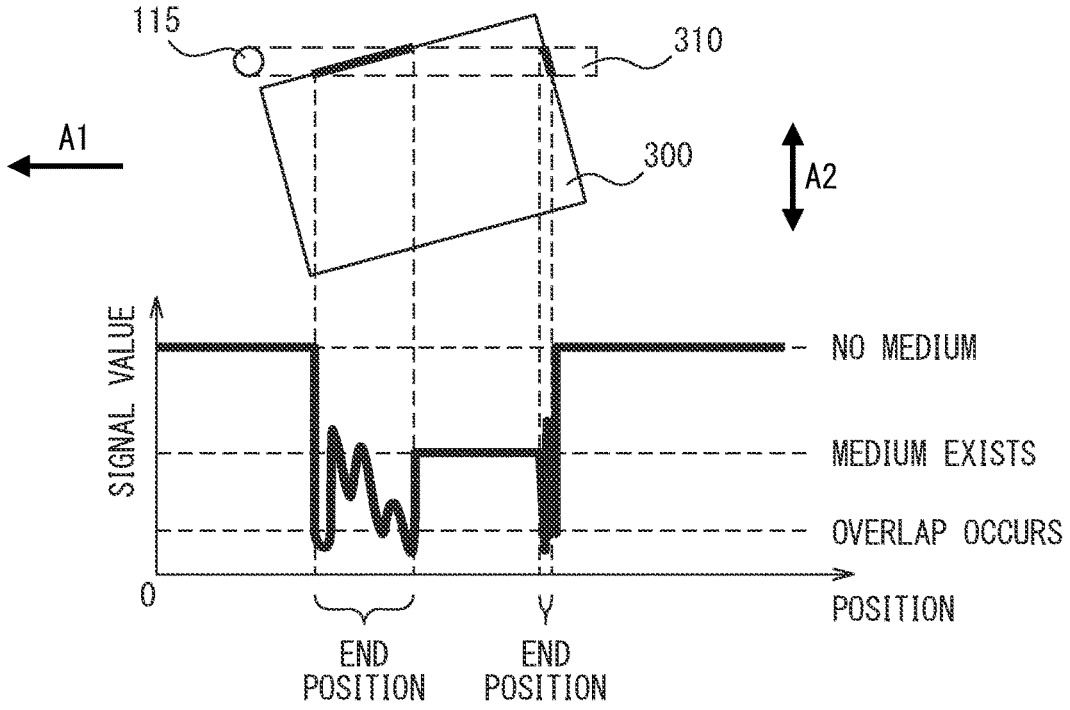
FIG. 10 is a schematic diagram for illustrating the characteristics of the ultrasonic signal intensity output from the ultrasonic sensor.

FIG. 10 is a schematic diagram for illustrating the characteristics of the ultrasonic signal output from the ultrasonic sensor.

FIG. 10 is a graph showing the signal value of the ultrasonic signal when the medium 300 is conveyed as shown in FIG. 9C. The horizontal axis of FIG. 10 indicates the position of the conveyed medium, and the vertical axis indicates the signal value of the ultrasonic signal (the intensity of the ultrasonic wave transmitted through the medium). The signal value of the ultrasonic signal indicates a relatively high value when the overlap of the medium has not occurred. On the other hand, the signal value of the ultrasonic signal indicates a relatively low value when the overlap of the medium has occurred. However, as shown in FIG. 10, when the positions of the ends 302 and 303 of the medium 300 are included in the detection area 310, so-called quenching phenomenon in which the transmission intensity of the ultrasonic is unstable may occur. Due to this quenching phenomenon, variations in the signal values in the ultrasonic signal may occur, and the signal values may indicate the same level of values as when the overlap of the media has occurred. The quenching phenomenon is caused by the decrease of the ultrasonic signal intensity due to the occurrence of interference of the ultrasonic waves diffracting by coming into contact with the end of the medium. The quenching phenomenon is also caused by the decrease of the intensity of the ultrasonic wave transmitted through the medium due to the end of the medium vibrated by the ultrasonic wave coming into contact with the end. In this way, when the positions of the ends 302 and 303 of the medium 300 are included in the detection area 310, it may be erroneously determined that the multi-feed has occurred, even though the multi-feed has not occurred. The determination module 153 can suppress erroneously determining that the multi-feed has occurred, by invalidating the multi-feed determination of the medium, when the position of the end of the conveyed medium is included in the detection area.

Figure 11:
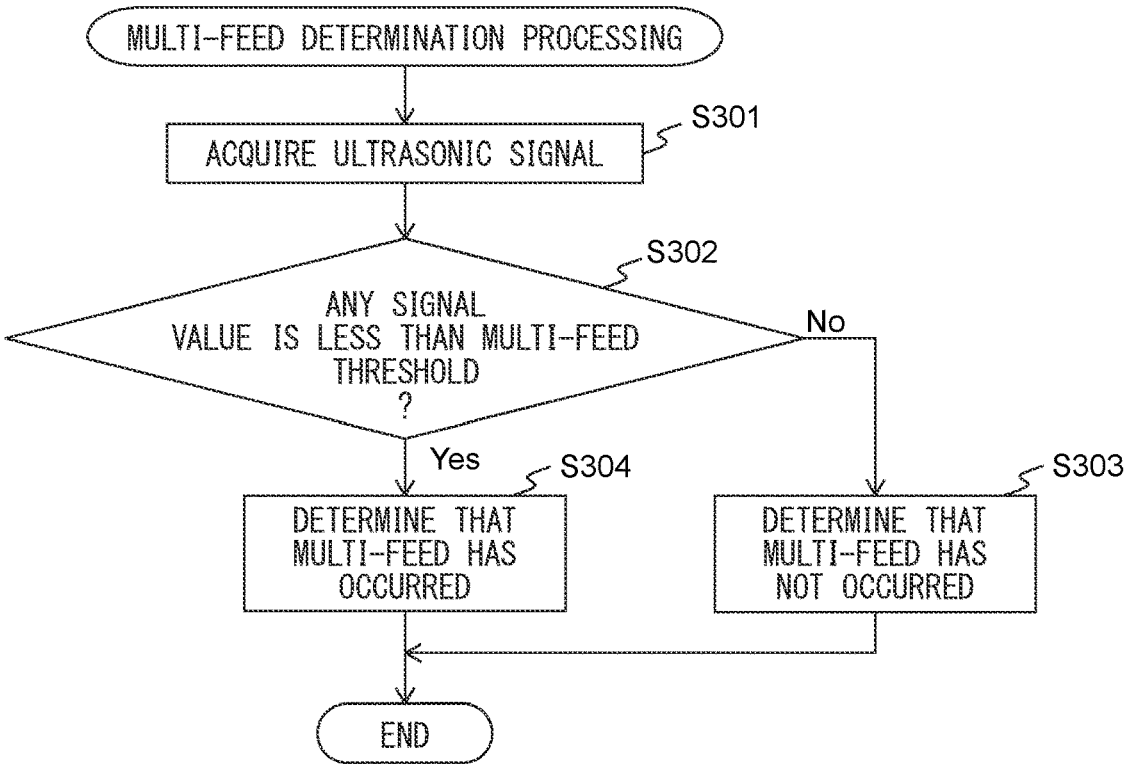
FIG. 11 is a flowchart illustrating an operation example of a multi-feed determination processing of the medium conveying apparatus 100.

FIG. 11 is a flowchart illustrating an operation example of the multi-feed determination processing of the medium conveying apparatus 100.

Referring to the flowchart illustrated in FIG. 11, an operation example of the multi-feed determination processing in the medium conveying apparatus 100 will be described below. The operation flow described below is executed mainly by the processing circuit 150 in cooperation with each element in the medium conveying apparatus 100, in accordance with a program previously stored in the storage device 140. The flow of the operation illustrated in FIG. 11 is periodically executed during medium conveyance.

First, the determination module 153 acquires the ultrasonic signal from the ultrasonic sensor 115 (step S301). Next, the determination module 153 determines whether or not the signal value of the acquired ultrasonic signal is less than the multi-feed threshold (step S302). The multi-feed threshold is set to a value between the signal value of the ultrasonic signal when a single medium is conveyed and the signal value of the ultrasonic signal when the multi-feed of the medium has occurred.

When the signal value of the ultrasonic signal is equal to or more than the multi-feed threshold, the determination module 153 determines that the multi-feed of the medium has not occurred (step S303), and ends the series of steps. On the other hand, when the signal value of the ultrasonic signal is less than the multi-feed threshold, the determination module 153 determines that the multi-feed of the medium has occurred (step S304), and ends the series of steps.

In this way, the determination module 153 determines whether or not the multi-feed of the medium has occurred based on the ultrasonic signal.

As described in detail above, when the position of the end of the conveyed medium is included in the area where the ultrasonic wave is transmitted through the medium, the medium conveying apparatus 100 invalidates the multi-feed determination of the medium. Thus, the medium conveying apparatus 100 can prevent erroneous determination of the multi-feed, and more accurately determine whether or not the multi-feed of the medium has occurred.

Although, in the above-described embodiment, the control module 151 executes the abnormality processing after detecting the position of the end portion of the medium, the control module 151 may execute the abnormality processing after generating the medium image acquired by synthesizing the line image generated by the imaging device 118. In this case, the processes of steps S104 to S110 are performed after the medium image is generated in step S113. The determination module 153 identifies the position of the end of the medium for each line in the horizontal direction in the medium image, to determine whether or not the position of the end is included in the detection area, and determine whether the overlap detection is valid or invalid, when the medium image is generated. Further, the control module 151 periodically acquires the ultrasonic signal and stores the signal value of the ultrasonic signal in the storage device 140 for each position in the medium conveying direction A1 in the medium. The determination module 153 determines whether or not the multi-feed of the medium has occurred based on the signal value of the ultrasonic signal stored in the storage device 140, for each position corresponding to the line in which the overlap detection is valid in the medium conveying direction A1 in the medium, when the medium image is generated.

Further, in the above-described embodiment, although the ultrasonic sensor to output the transmission information of the ultrasonic wave is used as the overlap detection sensor, the thickness sensor to detect thickness information of the medium may be used as the overlap detection sensor. The thickness sensor is located at a position where each ultrasonic sensor 115 is located. The thickness sensor includes a light emitter and a light receiver located close to the conveyance path of the medium in such a way as to face one another with the conveyance path in between. The light emitter emits light (infrared light or visible light) toward the light receiver. On the other hand, the light receiver receives the light emitted by the light emitter, and generates and outputs a thickness signal being an electric signal corresponding to the intensity of the received light. When a medium exists at the position of the thickness sensor, the light emitted by the light emitter is attenuated by the medium, and the greater the thickness of the medium, the greater the amount of attenuation. For example, the thickness sensor generates the thickness signal such that the greater the thickness of the medium, the greater the signal value.

A reflected light sensor, a pressure sensor or a mechanical sensor may be used as the thickness sensor. The reflected light sensor includes a pair of light emitter and light receiver provided on one side with respect to a conveyance path of the medium and a pair of light emitter and light receiver provided on the other side. The reflected light sensor detects a distance between each pair and each surface of the medium, based on a time from when one pair emits light to one surface of the medium to when it receives the reflected light and a time from when the other pair emits light to the other surface of the medium to when it receives the reflected light. The reflected light sensor generates a thickness signal which indicates a subtracted value acquired by subtracting each detected distance from a distance between the two pairs, as the thickness information. The pressure sensor detects a pressure which changes according to the thickness of the medium, and generates a thickness signal which indicates the detected pressure, as the thickness information. The mechanical sensor detects a movement amount of a roller in contact with the medium, and generates a thickness signal which indicates the detected movement amount, as the thickness information.

When the thickness sensor is used as an overlap detection sensor, an area facing each sensor on the conveyed medium is specified as the detection area of the thickness sensor. In the multi-feed determination processing, the determination module 153 acquires the thickness signal from the thickness sensor, instead of the ultrasonic signal, and determines whether or not the multi-feed of the medium has occurred depending on whether or not the signal value of the acquired thickness signal is equal to or more than the multi-feed threshold. Similar to the ultrasonic signal, in the thickness signal, variations in the signal values of the thickness signal may occur at the end of the medium when the end is collapsed or bent in the plane direction, and thereby, the signal value may indicate the same level of value as when the overlap of the medium has occurred. The determination module 153 can suppress erroneously determining that the multi-feed has occurred, by invalidating the multi-feed determination of the medium, when the position of the end of the conveyed medium is included in the detection area of the thickness sensor.

Further, in the above-described embodiment, although the feed roller 112 is located on the lower side of the brake roller 113 and feeds the medium placed on the medium tray 103 sequentially from the lower side, the feed roller may be located on the upper side of the brake roller so as to feed the medium placed on the medium tray sequentially from the upper side.

Although, in the embodiment described above, the imaging device is used as the end detection sensor, the end detection sensor is not limited thereto.

Figure 12:
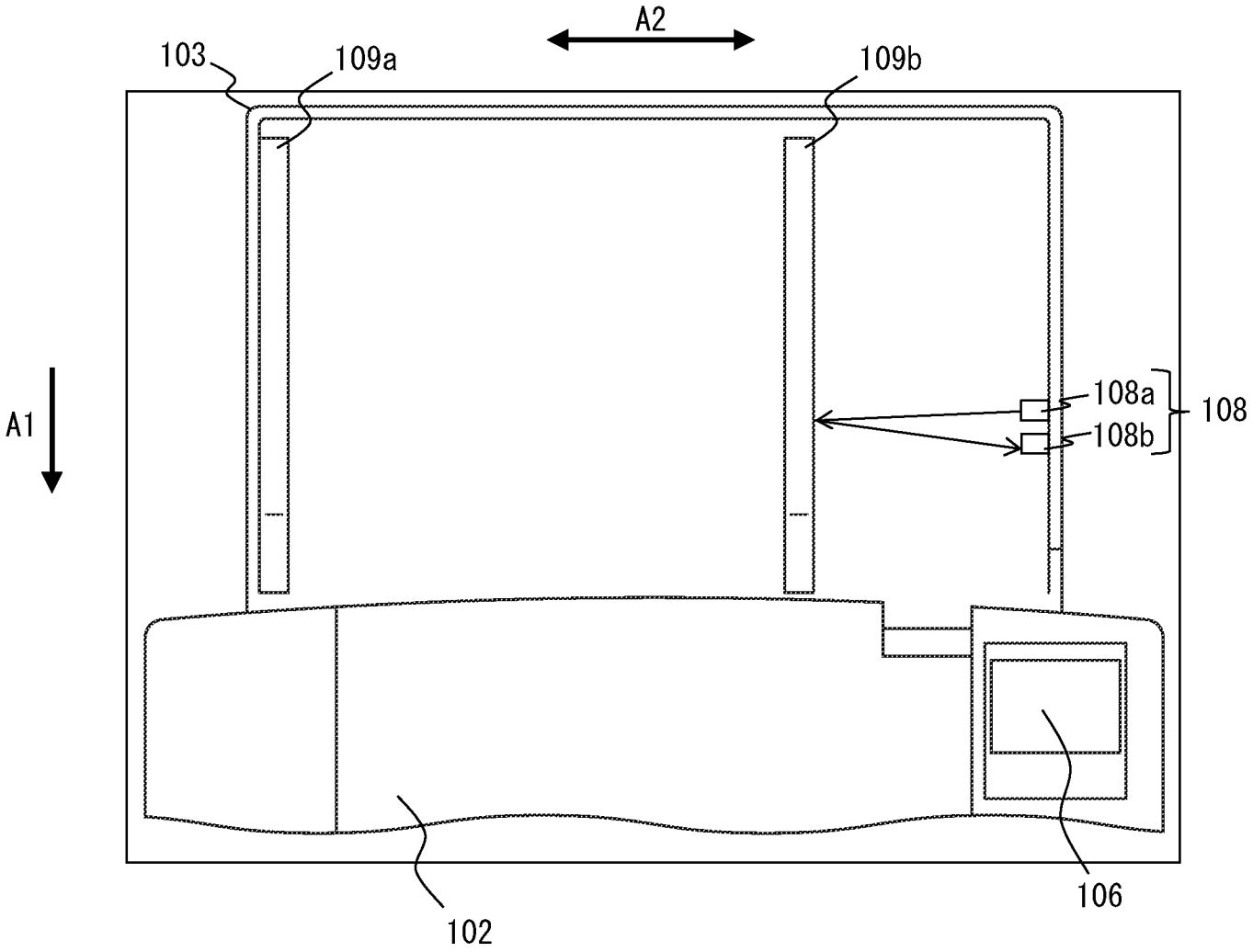
FIG. 12 is a diagram illustrating another example of detecting the position of the end of the medium.

FIG. 12 is a schematic diagram for illustrating other means to detect the end of the medium.

In an example shown in FIG. 12, the end detection sensor includes a distance measuring sensor 108 for detecting arrangement positions of the second side guide 109*b* to regulate a position in the width direction of the medium, and the control module 151 specifies the position of the end portion of the medium based on a detection result of the distance measuring sensor 108. Although, in the example shown in FIG. 12, it is described that the position of the second side guide 109*b* is measured, the position of the first side guide 109*a* may be measured in the same manner using the distance measuring sensor.

The distance measuring sensor 108 is located so as to overlap the second side guide 109*b* in the medium conveying direction A1, i.e., when viewed from the width direction A2, and at a predetermined position on the end side of the conveyance path in the width direction A2, to measure a distance from the located predetermined position to the second side guide 109*b*. The distance measuring sensor 108 measures a distance from an object existing at a facing position, based on a time difference from when it emits infrared rays to when it receives reflected infrared rays. The distance measuring sensor 108 includes a light emitter 108*a* and a light receiver 108*b*. The light emitter 108*a* emits infrared light toward the center side in the width direction A2, i.e., toward the second side guide 109*b*. On the other hand, the light receiver 108*b* receives the light emitted by the light emitter 108*a* and reflected by the second side guide 109*b*, and generates and outputs a detection signal being an electric signal corresponding to the time from when the light emitter 108*a* emits the light to when the light receiver 108*b* receives the light. In other words, the detection signal is a signal corresponding to the distance from the predetermined position at which the distance measuring sensor 108 is located to the second side guide 109*b*. The control module 151 acquires the distance between the distance measuring sensor 108 and the second side guide 109*b*, based on a position at which the distance measuring sensor 108 is located and the detection signal. Then, the control module 151 identifies the position of the end of the medium on the side of the second side guide 109*b*, based on the position at which the distance measuring sensor 108 is located, the distance between the distance measuring sensor 108 and the second side guide 109*b*, and a thickness of the second side guide 109*b*. In this way, the control module 151 identifies the position of the end of the medium based on a detection result by the distance measuring sensor 108.

The distance measuring sensor 108 may include a transmitter to transmit an ultrasonic wave and a receiver to receive the ultrasonic wave, instead of the light emitter 108*a* and the light receiver 108*b*, and measure the distance to the second side guide 109*b* based on the time difference from when it transmits the ultrasonic wave to when it receives the reflected ultrasonic wave. In that case, the distance measuring sensor 108 generates an electrical signal corresponding to the time from when the transmitter transmits the ultrasonic wave to when the receiver receives the ultrasonic wave, as a detection signal. Alternatively, the distance measuring sensor 108 may include a transmitter to transmit audible sounds and a receiver to receive an audible sound, and measure the distance to the second side guide 109*b* based on the time difference from when it transmits the audible sound to when it receives the reflected audible sounds. In that case, the distance measuring sensor 108 generates an electrical signal corresponding to the time from when the transmitter transmits the audible sound until the receiver receives the audible sound, as a detection signal.

Further, a conductor such as metal may be attached to the second side guide 109*b*, and an inductive proximity sensor including a coil, to detect a magnetic loss due to eddy currents generated on the conductor surface, may be used as the distance measuring sensor 108. In that case, the measuring sensor 108 generates an electrical signal corresponding to a magnitude of an impedance in the coil as a detection signal. Alternatively, a metal or a dielectric may be attached to the second side guide 109*b*, and a capacitive proximity sensor to detect a change in capacitance between the second side guide 109*b* and the distance measuring sensor 108, may be used as the distance measuring sensor 108. In that case, the distance measuring sensor 108 generates an electrical signal corresponding to the magnitude of the capacitance between the second side guide 109*b* and the distance measuring sensor 108 as a detection signal.

Further, a magnet may be attached to the second side guide 109*b*, and a magnetic sensor to detect a magnitude of the ground field (magnetic field) between the second side guide 109*b* and the distance measuring sensor 108, may be used, as the distance measuring sensor 108. In that case, the distance measuring sensor 108 generates an electrical signal corresponding to the magnitude of the magnetic field between the second side guide 109*b* and the distance measuring sensor 108 as a detection signal.

Further, a sensor including an optical rotary encoder, to detect an amount of a movement from an initial position of the second side guide 109*b* (predetermined position), may be used as the distance measuring sensor 108. The rotary encoder includes a disk in which a number of slits are formed and provided to rotate according to a movement of the second side guide 109*b*, and a light emitter and a light receiver provided to face each other with the disc in between. In that case, the distance measuring sensor 108 generates an electrical signal corresponding to the number of changes between a state in which the slit exists between the light emitter and the light receiver and a state in which the slit does not exist and the light emitter and the light receiver are blocked by the disk as a detection signal.

Further, a sensor including an optical linear encoder, to detect an amount of a movement from the initial position of the second side guide 109*b* (predetermined position), may be used as the distance measuring sensor 108. The optical linear encoder includes a glass scale on which a grating scale is formed, and a light emitter and a light receiver provided to face each other with the glass scale in between, and move according to the movement of the second side guide 109*b*. In that case, the distance measuring sensor 108 generates an electrical signal corresponding to the number of times of change in the light amount in the light receiver as a detection signal.

Further, a sensor including a magnetic linear encoder, to detect the amount of the movement from the initial position of the second side guide 109*b* (predetermined position), may be used as the distance measuring sensor 108. The magnetic linear encoder includes a magnetic scale on which a predetermined magnetic pattern is formed, and a magnetic detection head provided to face the magnetic scale, and move according to the movement of the second side guide 109*b*. In that case, the distance measuring sensor 108 generates an electrical signal corresponding to the number of change in the magnetism detected by the magnetic detection head, as a detection signal.

Further, a sensor including a sliding resistor, to detect a voltage by the sliding resistor may be used as the distance measuring sensor 108. The sliding resistor includes a resistor extending in the width direction A2 to which a constant voltage is applied from terminals at both ends, and a contact (slider) provided to move according to the movement of the second side guide 109*b* while in contact with the resistor. In that case, the second side guide 109*b* generates an electrical signal corresponding to the magnitude of the voltage applied from one end of the resistor to the slider as a detection signal.

Figure 13:
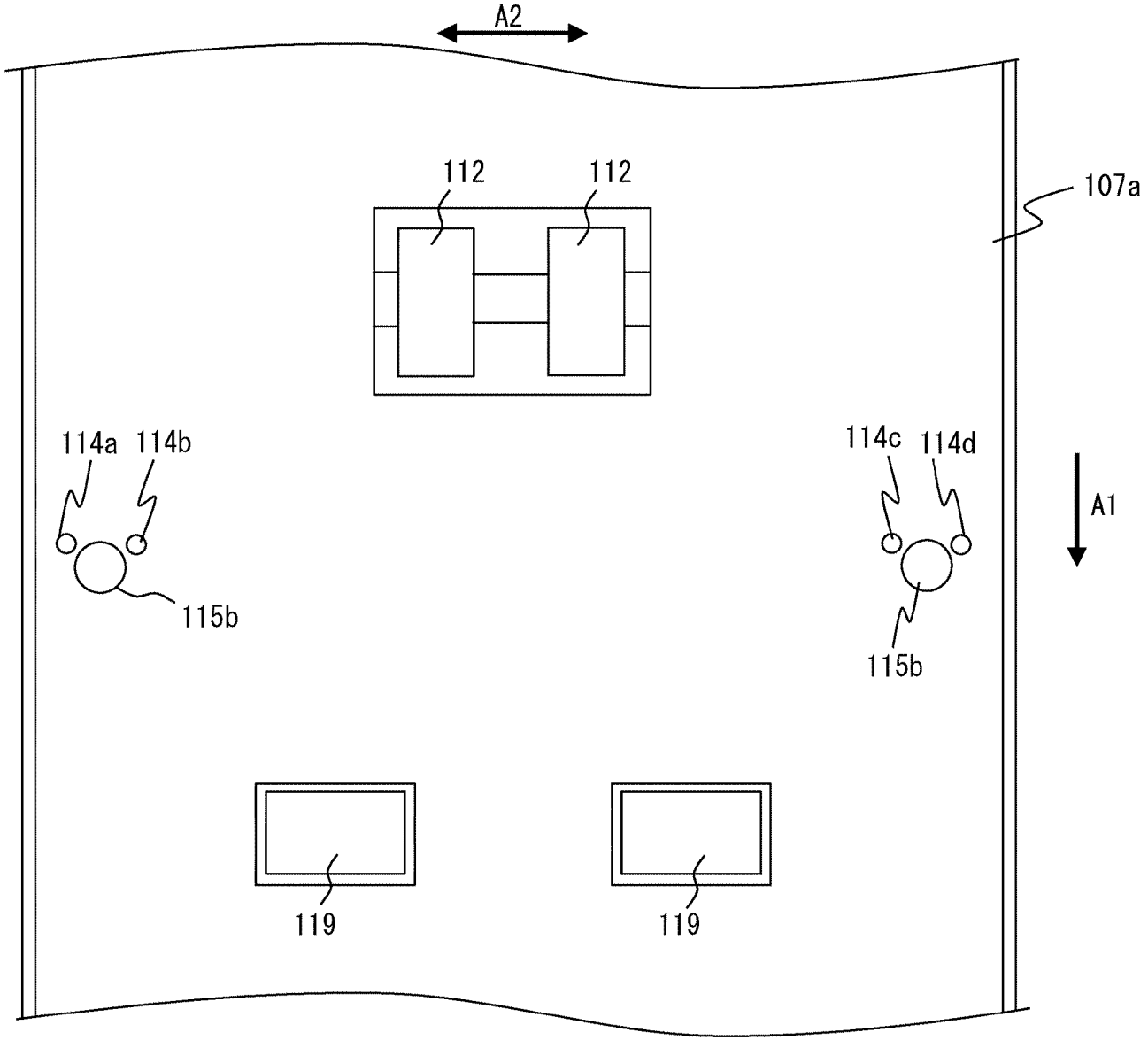
FIG. 13 is a schematic diagram for illustrating a still another means to detect the end position of the medium.

FIG. 13 is a schematic diagram for illustrating a still another means to detect the position of the end of the medium.

In an example shown in FIG. 13, the end detection sensor includes four medium sensors 114*a* to 114*d* for detecting the medium, and the control module 151 specifies the position of the end of the medium based on the detection results by the four medium sensors 114*a* to 114*d*.

The pair of medium sensors 114*a* and 114*b* and the pair of medium sensors 114*c* and 114*d* are located, respectively, so as to sandwich separate ultrasonic receivers 115*b* in the width direction A2.

When the position of the end of the medium is located between each pair of the medium sensors, one medium sensor detects the medium, but the other medium sensor does not detect the medium. The determination module 153 determines that the position of the end of the conveyed medium is included in the detection area, and determines that the overlap detection is invalid when the position of the end of the conveyed medium is located between the pair of the medium sensors.

Further, a number of medium sensors 114 may be located along in the width direction perpendicular to the medium conveying direction, and the medium conveying apparatus 100 may detect the position of the end of the medium.

Figure 14:
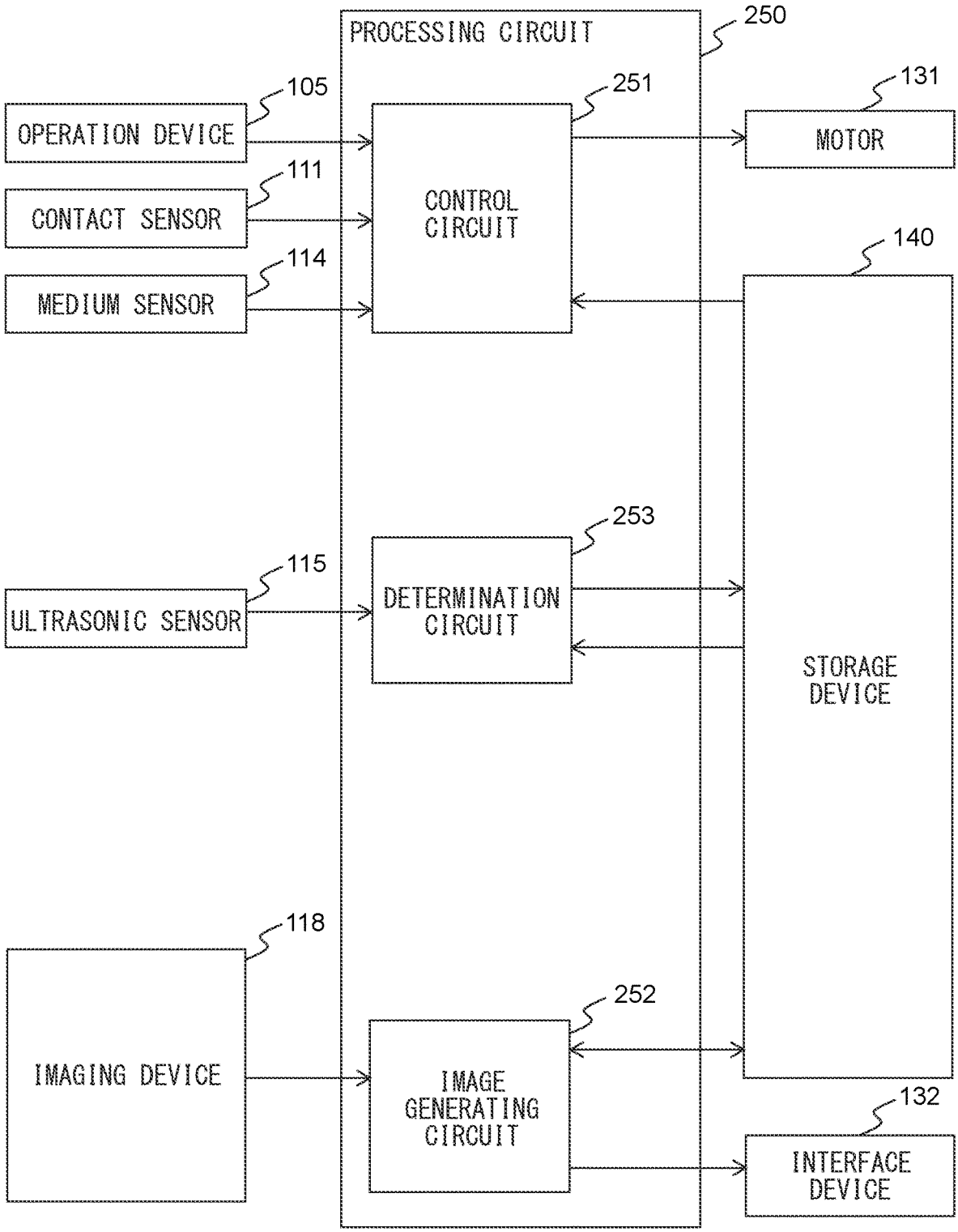
FIG. 14 is a diagram illustrating a schematic configuration of another processing circuit 250.

FIG. 14 is a diagram illustrating a schematic configuration of a processing circuit 250 in a medium conveying apparatus according to another embodiment. The processing circuit 250 is used in place of the processing circuit 150 in the medium conveying apparatus 100 and executes the medium reading processing and the determination processing in place of the processing circuit 150. The processing circuit 250 includes a control circuit 251, an image generating circuit 252 and a determination circuit 253, etc. Note that each unit may be configured by an independent integrated circuit, a microprocessor, firmware, etc.

The control circuit 251 is an example of a control module and has a function similar to the control module 151. The control circuit 251 receives the operation signal from the operation device 105, the first medium signal from the contact sensor 111, and the second medium signal from the medium sensor 114, and reads the determination result of the multi-feed of the medium from the storage device 140. The control circuit 251 outputs a control signal to the motor 131 so as to control the feeding and conveying of the medium in response to each information received or read. Further, the control circuit 251 executes the abnormality processing for the multi-feed based on the determination result of the multi-feed of the medium.

The image generating circuit 252 is an example of an image generating module and has a function similar to the image generating module 152. The image generating circuit 252 receives the line image from the imaging device 118 and stores it in the storage device 140, generates the medium image, and transmits it to the information processing apparatus via the interface device 132.

The determination circuit 253 is an example of a determination module has a functions similar to the determination module 153. The determination circuit 253 reads the line image from the storage device 140, receives the ultrasonic signal from the ultrasonic sensor 115, determines whether or not the multi-feed of the medium has occurred based on the information received or read, and stores the determination result in the storage device 140.

As described in detail above, the medium conveying apparatus can more accurately determine whether or not the conveyance abnormality of the medium has occurred even when using the processing circuit 250.

According to the embodiment, the medium conveying apparatus, the method, and the computer-readable, non-transitory medium storing the control program, can more accurately determine whether or not the multi-feed of the medium has occurred.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus comprising:

a conveying roller to convey a medium;

an end detection sensor for detecting a position of an end of the medium conveyed by the conveying roller;

an overlap detection sensor for detecting an overlap of the medium conveyed by the conveying roller in a detection area; and a processor to determine whether an overlap detection is valid or invalid based on whether a position of the end of the medium detected by the end detection sensor is included in the detection area, and execute an abnormality processing for multi-feed based on a detection result by the overlap detection sensor when it is determined that the overlap detection is valid.

2. The medium conveying apparatus according to claim 1, wherein the overlap detection sensor includes a receiver to detect a transmission intensity of an ultrasonic wave transmitted through the medium, and wherein the detection area is an area on the medium passing over the receiver.

3. The medium conveying apparatus according to claim 1, wherein the end detection sensor is an imaging device to generate an input image acquired by imaging the medium, and wherein the processor identifies the position of the end of the medium based on the input image.

4. The medium conveying apparatus according to claim 3, wherein the processor executes the abnormality processing after detecting the position of the end of the medium or after generating a medium image acquired by synthesizing the input image generated by the imaging device.

5. The medium conveying apparatus according to claim 1, wherein the end detection sensor includes a first detection sensor for detecting the medium, and wherein the processor identifies the position of the end of the medium based on a detection result by the first detection sensor.

6. The medium conveying apparatus according to claim 1, wherein the end detection sensor includes a second detection sensor for detecting an arrangement position of a side guide to regulate a position in a width direction of the medium, and wherein the processor identifies the position of the end of the medium based on a detection result by the second detection sensor.

7. The medium conveying apparatus according to claim 5, wherein the processor executes the abnormality processing while the medium is conveyed by the conveying roller.

8. The medium conveying apparatus according to claim 1, wherein the processor determines that the overlap detection is invalid when the position of the end of the conveyed medium is included in the detection area.

9. A method for executing an abnormality processing, comprising:

conveying a medium, by a conveying roller;

determining whether an overlap detection is valid or invalid based on whether a position of an end of the medium detected by an end detection sensor for detecting the position of the end of the medium conveyed by the conveying roller is included in a detection area in which an overlap detection sensor detects an overlap of the medium conveyed by the conveying roller; and executing an abnormality processing for multi-feed based on a detection result by the overlap detection sensor when it is determined that the overlap detection is valid.

10. The method according to claim 9, wherein the overlap detection sensor includes a receiver to detect a transmission intensity of an ultrasonic wave transmitted through the medium, and wherein the detection area is an area on the medium passing over the receiver.

11. The method according to claim 9, wherein the end detection sensor is an imaging device to generate an input image acquired by imaging the medium, and wherein the position of the end of the medium is identified based on the input image.

12. The method according to claim 11, wherein the abnormality processing is executed after detecting the position of the end of the medium or after generating a medium image acquired by synthesizing the input image generated by the imaging device.

13. The method according to claim 9, wherein the end detection sensor includes a first detection sensor for detecting the medium, and wherein the position of the end of the medium is identified based on a detection result by the first detection sensor.

14. The method according to claim 9, wherein the end detection sensor includes a second detection sensor for detecting an arrangement position of a side guide to regulate a position in a width direction of the medium, and wherein the position of the end of the medium is identified based on a detection result by the second detection sensor.

15. A computer-readable, non-transitory medium storing a computer program, wherein the computer program causes a medium conveying apparatus including a conveying roller to convey a medium, an end detection sensor for detecting a position of an end of the medium conveyed by the conveying roller, and an overlap detection sensor for detecting an overlap of the medium conveyed by the conveying roller in a detection area, to execute a process, the process comprising:

determining whether an overlap detection is valid or invalid based on whether a position of the end of the medium detected by the end detection sensor is included in the detection area; and executing an abnormality processing for multi-feed based on a detection result by the overlap detection sensor when it is determined that the overlap detection is valid.

16. The computer-readable, non-transitory medium according to claim 15, wherein the overlap detection sensor includes a receiver to detect a transmission intensity of an ultrasonic wave transmitted through the medium, and wherein the detection area is an area on the medium passing over the receiver.

17. The computer-readable, non-transitory medium according to claim 15, wherein the end detection sensor is an imaging device to generate an input image acquired by imaging the medium, and wherein the position of the end of the medium is identified based on the input image.

18. The computer-readable, non-transitory medium according to claim 17, wherein the abnormality processing is executed after detecting the position of the end of the medium or after generating a medium image acquired by synthesizing the input image generated by the imaging device.

19. The computer-readable, non-transitory medium according to claim 15, wherein the end detection sensor includes a first detection sensor for detecting the medium, and wherein the position of the end of the medium is identified based on a detection result by the first detection sensor.

20. The computer-readable, non-transitory medium according to claim 15, wherein the end detection sensor includes a second detection sensor for detecting an arrangement position of a side guide to regulate a position in a width direction of the medium, and wherein the position of the end of the medium is identified based on a detection result by the second detection sensor.

* * * * *